US008851473B2

(12) United States Patent
Lai et al.

(10) Patent No.: US 8,851,473 B2
(45) Date of Patent: Oct. 7, 2014

(54) SHEET ARTICLE SEPARATING MECHANISM AND CONTROL METHOD AND CONTROL SYSTEM THEREOF

(75) Inventors: Zhongwu Lai, Guangzhou (CN); Fazhi Yin, Guangzhou (CN); Zhiqiang Sun, Guangzhou (CN)

(73) Assignee: GRG Banking Equipment Co., Ltd., Guangzhou (CN)

( * ) Notice: Subject to any disclaimer, the term of this patent is extended or adjusted under 35 U.S.C. 154(b) by 0 days.

(21) Appl. No.: 13/883,993

(22) PCT Filed: Jul. 9, 2012

(86) PCT No.: PCT/CN2012/078347

§ 371 (c)(1),
(2), (4) Date: May 8, 2013

(87) PCT Pub. No.: WO2013/034022

PCT Pub. Date: Mar. 14, 2013

(65) Prior Publication Data

US 2013/0221606 A1 Aug. 29, 2013

(30) Foreign Application Priority Data

Sep. 8, 2011 (CN) ..... 2011 1 0265863

(51) Int. Cl.

| | |
|---|---|
| ***B65H 5/34*** | (2006.01) |
| ***B65H 3/06*** | (2006.01) |
| ***B65H 7/02*** | (2006.01) |
| ***B65H 3/04*** | (2006.01) |
| ***B65H 3/52*** | (2006.01) |

(52) U.S. Cl.

CPC .. *B65H 3/04* (2013.01); *B65H 7/02* (2013.01); *B65H 3/52* (2013.01); *B65H 2701/1912* (2013.01); *B65H 3/06* (2013.01)

USPC ..... 271/270; 271/119; 271/114

(58) Field of Classification Search

USPC ..... 271/270, 119, 131, 23, 165, 114

See application file for complete search history.

(56) References Cited

U.S. PATENT DOCUMENTS 3,506,258 A * 4/1970 Lindquist ..... 271/119
4,331,328 A * 5/1982 Fasig ..... 271/270

(Continued)

FOREIGN PATENT DOCUMENTS

CN 1833972 A 9/2006
CN 100999287 A 7/2007

(Continued)

*Primary Examiner* — Patrick Cicchino

(74) *Attorney, Agent, or Firm* — Kilpatrick Townsend & Stockton LLP

(57) ABSTRACT

A sheet medium separating mechanism and a control method and a control system thereof. When the head part of a currently separated medium reaches the front boundary of a preset speed regulating region in front of a money distributing wheel (111) and the tail part of the currently separated medium leaves the back boundary of a preset speed regulating region on the money distributing wheel, relative speeds of a money distributing wheel motor (122) and a back money distributing power wheel motor (120) are regulated, so that a preset medium separating distance is kept between the tail part of the currently separated medium and the head part of a next separated medium. Therefore, the sheet medium separating mechanism is adapted to sheet media of different shapes and different specifications, the money distributing wheel size and rotary inertia of longitudinal deposit equipment are reduced, and the motor load is effectively lowered.

11 Claims, 7 Drawing Sheets

(56) References Cited

U.S. PATENT DOCUMENTS

| | | | | |
|---|---|---|---|---|
| 4,451,027 | A * | 5/1984 | Alper | 271/10.02 |
| 6,533,263 | B2 * | 3/2003 | Tamura | 271/10.01 |
| 6,554,275 | B1 * | 4/2003 | Tranquilla | 271/259 |
| 6,889,972 | B2 * | 5/2005 | Chang | 271/23 |
| 7,419,155 | B2 * | 9/2008 | Stoll et al. | 271/131 |
| 8,006,976 | B2 * | 8/2011 | Suzuki et al. | 271/270 |
| 8,172,218 | B2 * | 5/2012 | Suzuki et al. | 271/10.01 |
| 8,256,760 | B2 * | 9/2012 | Dacunha et al. | 271/3.21 |
| 8,387,978 | B2 * | 3/2013 | Fukasawa et al. | 271/270 |
| 2008/0063449 | A1 | 3/2008 | Fukasawa et al. | |
| 2010/0237557 | A1 * | 9/2010 | Hara et al. | 271/225 |
| 2012/0061905 | A1 * | 3/2012 | Wu et al. | 271/34 |

FOREIGN PATENT DOCUMENTS

| | | | | |
|---|---|---|---|---|
| CN | 201566196 | U | 9/2010 | |
| CN | 102431813 | A | 5/2012 | |
| JP | 63282032 | A * | 11/1988 | B65H 3/52 |
| JP | S6428133 | A | 1/1989 | |
| JP | 3031128 | A | 2/1991 | |
| JP | 4266351 | A | 9/1992 | |

* cited by examiner

SHEET ARTICLE SEPARATING MECHANISM AND CONTROL METHOD AND CONTROL SYSTEM THEREOF

This application is the U.S. national phase of International Application No. PCT/CN2010/078347 field on Jul. 9, 2012, which claims the priority of the Chinese Patent Application No. 2011102658618, entitled "SHEET ARTICLE SEPARATING MECHANISM AND CONTROL METHOD AND CONTROL SYSTEM THEREOF", filed with the Chinese Patent Office on Sep. 8, 2011, which is incorporated herein by reference in its entirety.

FIELD THE INVENTION

The present invention relates to the field of financial automation equipment, and particularly to a separation mechanism for dealing with sheet medium and cheque-like sheet matter, as well as a system and a method for controlling the same, which is mainly applied to the field of stacked sheet matter separation equipment, etc.

BACKGROUND OF THE INVENTION

Existing sheet matter separation mechanism, in particular a sheet medium separation mechanism, commonly adopts the way of separation in which the rotating velocity of the banknote separating wheel is constant, one sheet medium is separated and the banknote separating rubber touches the sheet medium for only one time in a rotation period of the banknote separating wheel. Such the separation mechanism includes the components for separating sheet medium, such as a banknote picking wheel, a reverse wheel, a banknote separating wheel and a motor, etc. When stacked sheet media are placed on the banknote picking wheel, the motor is started under the control, the motor drives the banknote picking wheel and the banknote separating wheel to rotate synchronously; after the banknote picking wheel transferring the stacked sheet media to the banknote separating wheel, the banknote separating wheel and the reverse wheel separate one sheet medium from the stacked sheet media, and then take the separated sheet medium away using a follow-up channel; repeating the steps, the stacked sheet media can be separated.

However, for the sheet media in one country, the different media have different shapes and size specifications, for example, the size specification of the banknote and that of cheque are quite different from each other. If these sheet media are separated when they are mixed together, the rotation numbers of the banknote separating wheel are different when separating different sheet media, and there are different spacing between the separated sheet media: if the spacing between the separated sheet media is too small, the crash occurs due to the insufficient of the response time of the inverter in the follow-up channel, that is, the crash occurs due to the insufficient of the response time of the inverter during the inverting; if the spacing is too large, waste of resource may be caused; therefore, if the spacing between the sheet media is too small in the process of separation, the banknote will be rejected (one of the reasons that the banknote is rejected), the rate of the rejection may be increased, and the effect of the machine may be affected. In particular, for the longitudinal deposit device, because the length of the sheet medium is long in the longitudinal direction, one sheet medium is separated and the banknote separating rubber touches the sheet medium for one time in a rotation period of the banknote separating wheel, in that case, the volume of the banknote separating wheel will be very large. For example, if a cheque with a length of 250 mm is separated in this way, the required diameter of a banknote separating wheel is at least larger than 79.5 mm, hence, the device that requires a small volume is influenced; meanwhile, the moment of inertia of the banknote separating wheel will be great, and the load of the motor is increased.

SUMMARY OF THE INVENTION

In view of this, an object of the invention is to provide a sheet matter separation mechanism and a system and method for controlling the same, for effectively solving the problem that the spacings between the separated media with different lengths are unidentical.

To solve the above technical problem, according to the invention, it is provided a solution which is a sheet matter separation mechanism, and the sheet matter separation mechanism includes a banknote picking wheel assembly and a banknote separating wheel assembly driven by a banknote separating wheel motor synchronously, a driving wheel assembly of post-banknote separation driven by a driving wheel motor of post-banknote separation, a banknote separating rubber being fitted on a banknote separating wheel of the banknote separating wheel assembly, the banknote separating rubber touching a medium for one time with the help of rotation of the banknote separating wheel for one circuit; if a front of a currently-separated medium reaches a front boundary of a preset velocity adjusting region in front of the banknote separating wheel and a rear of the currently-separated medium leaves a rear boundary of the preset velocity adjusting region, a relative velocity between the banknote separating wheel motor and the driving wheel motor of post-banknote separation is adjusted, such that a preset medium separation spacing is kept between a rear of the currently-separated medium and a front of a next-separated medium.

Preferably, the front boundary of the preset velocity adjusting region corresponds to the position that is at a distance of a maximum permitted medium length in front of the minimum spacing between the banknote separating wheel and a reverse wheel, and the rear boundary of the preset velocity adjusting region corresponds to a position where the medium leaves the banknote separating rubber on the banknote separating wheel.

Preferably, the preset medium separation spacing is the product of safe inverting response time of an inverter in a medium separating channel and a transfer velocity of the medium.

Preferably, a driving synchronous belt of post-banknote separation is connected between the driving wheel assembly of post-banknote separation and the banknote separating wheel assembly.

Preferably, a first rear pressure wheel and a second rear pressure wheel are provided above the driving synchronous belt of post-banknote separation, the first rear pressure wheel is close to a banknote separating spacing formed by the banknote separating wheel and the reverse wheel, and the second rear pressure wheel is close to the driving wheel assembly of post-banknote separation.

Further, according to the invention, it is provided a corresponding method for controlling the sheet matter separation mechanism, and the method includes: determining whether there exists a medium at the banknote picking wheel assembly, if yes, starting the banknote separating wheel motor and the driving wheel motor of post-banknote separation at a normal banknote separation velocity;

determining whether the front of the currently-separated medium reaches the front boundary of the preset velocity adjusting region and the rear of the currently-separated medium leaves the rear boundary of the preset velocity adjusting region, if yes, slowing down the rotating velocity of he banknote separating wheel motor to a preset value; and determining whether the rear of the currently-separated medium leaves the front boundary of the preset velocity adjusting region, if yes, increasing the rotating velocity of the banknote separating wheel motor to a normal banknote separation velocity.

Meanwhile, according to the invention, it is further provided a corresponding system for controlling the sheet matter separation mechanism and the system includes:

a medium detecting unit comprising a first sensor mounted at the banknote picking wheel assembly, a second sensor mounted at the front boundary of the preset velocity adjusting region, and a third sensor mounted at the rear boundary of the preset velocity adjusting region;

a processing unit, adapted to output a first control signal if a detection signal of the first sensor indicates that there exists a medium at the banknote picking wheel assembly, output a second control signal if a detection signal of the second sensor indicates that the front of the currently-separated medium reaches the front boundary of the preset velocity adjusting region and a detection signal of the third sensor indicates that the rear of the currently-separated medium leaves the rear boundary of the preset velocity adjusting region, and output a third control signal if the detection signal of the second sensor indicates that the rear of the currently-separated medium leaves the front boundary of the preset velocity adjusting region; and an execution unit including the banknote separating wheel motor and the driving wheel motor of post-banknote separation, the banknote separating wheel motor and the driving wheel motor of post-banknote separation are started at a normal banknote separation velocity according to the first control signal; the banknote separating wheel motor is decelerated to a preset value according to the second control signal; the banknote separating wheel motor is accelerated to the normal banknote separation velocity according to the third control signal.

Preferably, the system further includes a storage unit, adapted to read and write control parameters required by the processing unit.

Preferably, the system further includes a control unit, adapted to dispatch and control processes of the medium detecting unit, the processing unit, the execution unit, a detection module and the storage unit.

Preferably, the third sensor is a banknote separating wheel encoder sensor, a banknote separating wheel encoder is fitted on a rotating shaft of the banknote separating wheel, an opening direction and an opening angle of the banknote separating wheel encoder respectively match with that of the banknote separating rubber.

Compared with the prior art, according to the invention, the structure of the software and hardware of the sheet matter separation mechanism is improved, and when the front of the currently-separated medium reaches the front boundary of the preset velocity adjusting region in front of the banknote separating wheel and the rear of the currently-separated medium leaves away from the back boundary of the preset velocity adjusting region on the banknote separating wheel, the relative velocity between the banknote separating wheel motor and the driving wheel motor of post-banknote separation is adjusted, the constant spacing between the separated medium is ensured, thus adapting to sheet medium with different shapes and specifications; in particular, the volume of the banknote separating wheel of a longitudinal deposit equipment is reduced, the moment of inertia of the banknote separating wheel is decreased and the motor load is effectively reduced.

Figure 1:
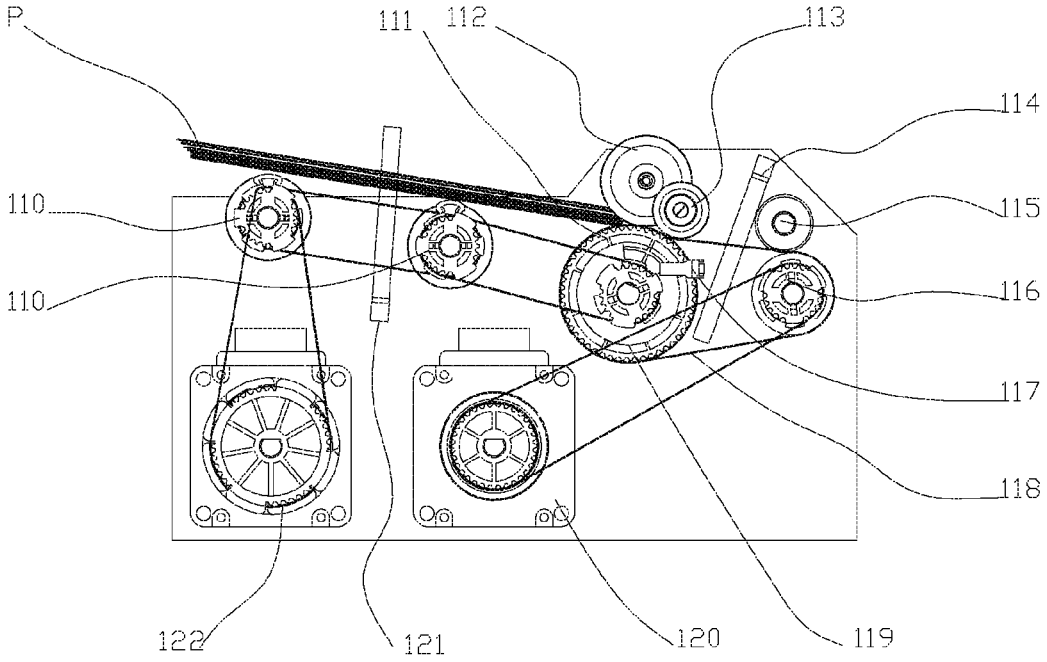
FIG. 1 is a schematic side view of a preferred embodiment of a sheet matter separation mechanism of the invention.

In drawings, related reference numerals are as follows:

| | |
|---|---|
| P. sheet medium; | 110. banknote picking wheel assembly; |
| 111. banknote separating wheel assembly; | 111-1. banknote separating wheel; |
| 111-2. driven synchronous belt pulley; | 111-3. banknote separating rubber; |
| 112. reverse wheel assembly; | 113. first rear pressure wheel; |
| 114. banknote separating wheel velocity adjusting sensor; | |
| 115. second rear pressure wheel; | |
| 116. driving wheel assembly of post-banknote separation; | |
| 117. banknote separating wheel encoder sensor; | |
| 118. driving synchronous belt of post-banknote separation; | |
| 119. banknote separating wheel encoder; | |
| 120. driving wheel motor of post-banknote separation; | |
| 121. sheet medium existence detecting sensor; | |
| 122. banknote separating wheel motor; | |

DETAILED DESCRIPTION OF THE INVENTION

The core idea of the invention is that if the front of the currently-separated medium reaches the front boundary of the preset velocity adjusting region in front of the banknote separating wheel and the rear of the currently-separated medium leaves the rear boundary of the preset velocity adjusting region, the relative velocity between the banknote separating wheel motor and the driving wheel motor of post banknote separation is adjusted, such that a preset medium separation spacing is kept between the rear of the currently-separated medium and the front of the next-separated medium.

Based on the basic idea described above, it is possible that the attributes (for example, physical attributes, image features, etc.) of the medium or the current physical position of the medium are detected and fed back to a controller, thereby the relative velocity between the banknote separating wheel motor and the driving wheel motor of post-banknote separation is controlled according to the predetermined policy. Specifically, there are many solutions such as the banknote separating wheel motor is decelerated while the driving wheel motor of post-banknote separation maintains normal velocity, or the banknote separating wheel motor maintains normal velocity while the driving wheel motor of post-banknote separation is accelerated, and so on. Therefore, keeping preset medium separation spacing between the rear of the currently-separated medium and the front of the next-separated medium can be achieved by changing the relative velocity between the banknote separating wheel motor and the driving wheel motor of post-banknote separation.

In order to make those skilled in the art better understand the technical solutions of the invention, the invention is further described in detail hereinafter in conjunction with the drawings and specific embodiments by taking the first solution aforementioned as an example.

Referring to FIGS. 1 to 5, the basic structure of a sheet matter separation mechanism of the invention is shown, which is a solution by detecting the position of the medium. In the medium separating channel of the separation mechanism, there is provided a banknote picking wheel assembly 110, a banknote separating wheel assembly 111, a reverse wheel assembly 112, a first rear pressure wheel 113, a banknote separating wheel velocity adjusting sensor 114, a second rear pressure wheel 115, a driving wheel assembly of post-banknote separation 116, a banknote separating wheel encoder sensor 117, a driving synchronous belt of post-banknote separation 118, a banknote separating wheel encoder 119, a driving wheel motor of post-banknote separation 120, a sheet medium existence detecting sensor 121 and a banknote separating wheel motor 122, etc.

The driving synchronous belt of post-banknote separation 118 is connected between the driving wheel assembly of post-banknote separation 116 and the banknote separating wheel assembly 111;

correspondingly, the first rear pressure wheel 113 and the second rear pressure wheel 115 are provided above the driving synchronous belt of post-banknote separation 118, the first rear pressure wheel 113 is close to the banknote separating spacing formed by the banknote separating wheel and the reverse wheel, and the second rear pressure wheel 115 is close to the driving wheel assembly of post-banknote separation 116;

the banknote picking wheel assembly 110 and the banknote separating wheel assembly 111 are driven by the banknote separating wheel motor 122 synchronously, the driving wheel assembly of post-banknote separation 116 is driven by the driving wheel motor of post-banknote separation 120, if the front of the currently-separated medium reaches the front boundary of the preset velocity adjusting region in front of the banknote separating wheel and the rear of the currently-separated medium leaves the rear boundary of the preset velocity adjusting region, by adjusting the relative velocity between the banknote separating wheel motor 122 and the driving wheel motor of post-banknote separation 120, a preset medium separation spacing is kept between the front of the currently-separated medium and the rear of the previously-separated medium.

In this embodiment, the front boundary of the preset velocity adjusting region preferably corresponds to the position that is at a distance of the maximum permitted medium length in front of the minimum spacing between the banknote separating wheel and the reverse wheel, and the rear boundary of the preset velocity adjusting region corresponds to the position where the medium leaves the banknote separating rubber on the banknote separating wheel, and the preset medium separation spacing is the product of the safe inverting response time of the inverter in the medium separating channel and the transfer velocity of the medium, the embodiment will be further described hereinafter in conjunction with the drawings.

Figure 2:
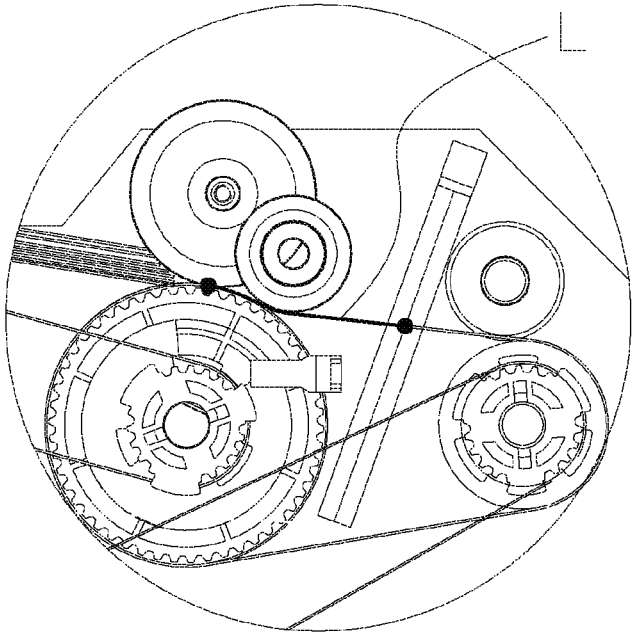
FIG. 2 is a partial enlarged view of FIG. 1.
Figure 3:
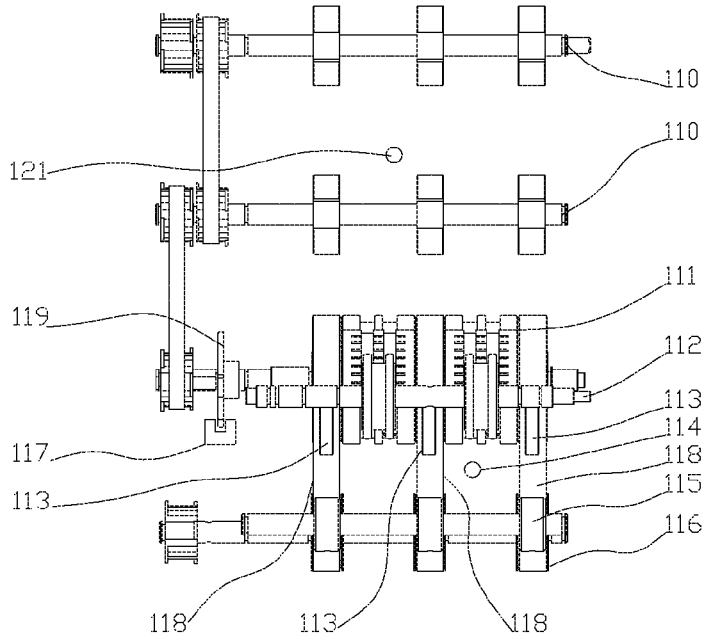
FIG. 3 is a schematic plan view of the sheet matter separation mechanism shown in FIG. 1.

As shown in FIG. 2, which is a partial enlarged view of the separation mechanism, the length of L is the spacing between the separated sheet media, which has a minimum value. Specifically, the minimum value is the product of the safe inverting response time of the inverter in the medium separating channel and the transfer velocity of the medium.

Figure 4:
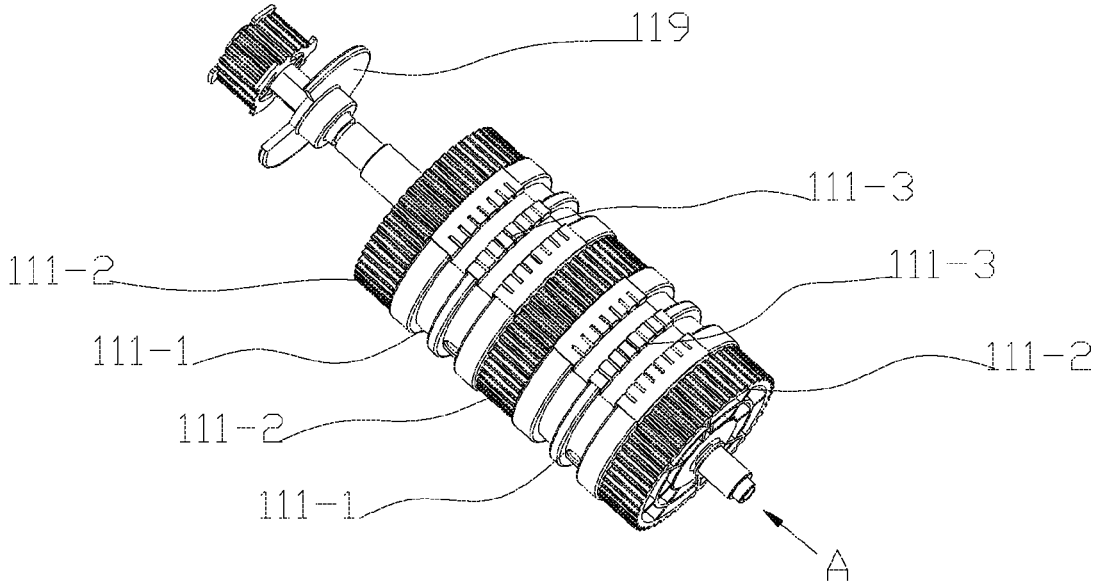
FIG. 4 is a three-dimensional schematic view of the sheet-like item banknote separating wheel assembly shown in FIG. 1.
Figure 5:
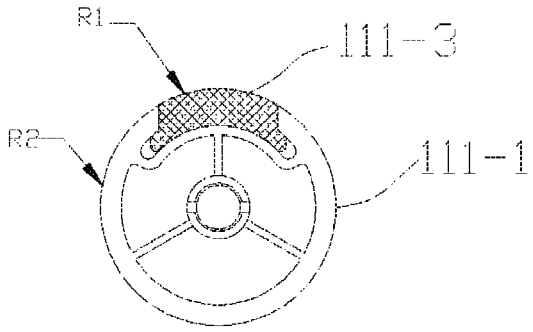
FIG. 5 is a view of FIG. 4 taken along the direction A.
Figure 6:
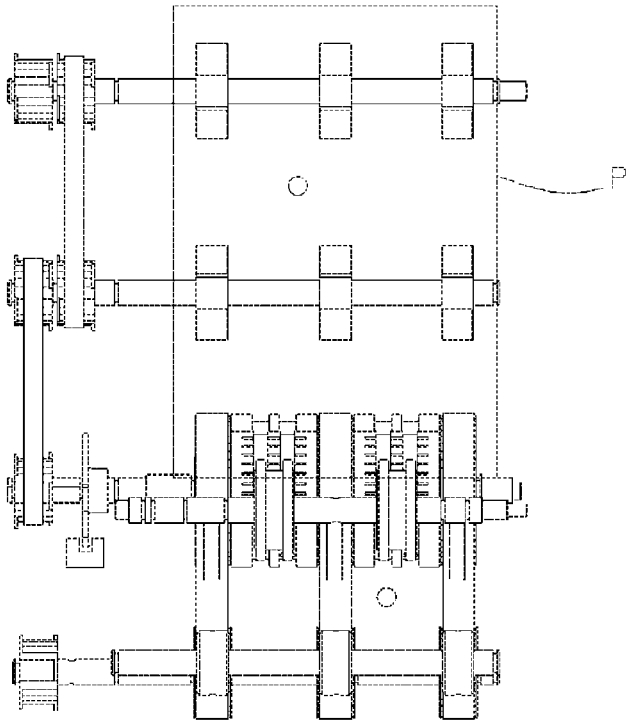
FIG. 6 is a schematic view of a first sheet separation state.
Figure 7:
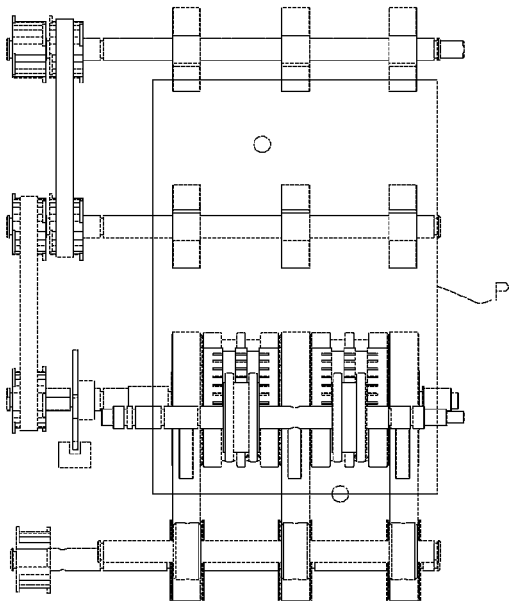
FIG. 7 is a schematic view of a second sheet separation state.
Figure 8:
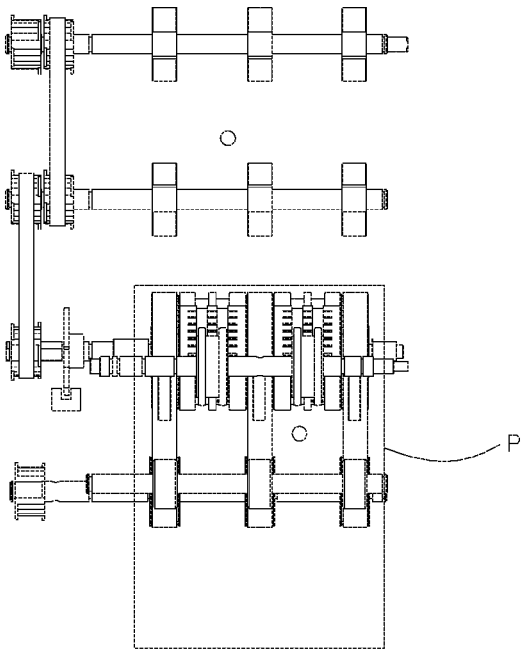
FIG. 8 is a schematic view of a third sheet separation state.
Figure 9:
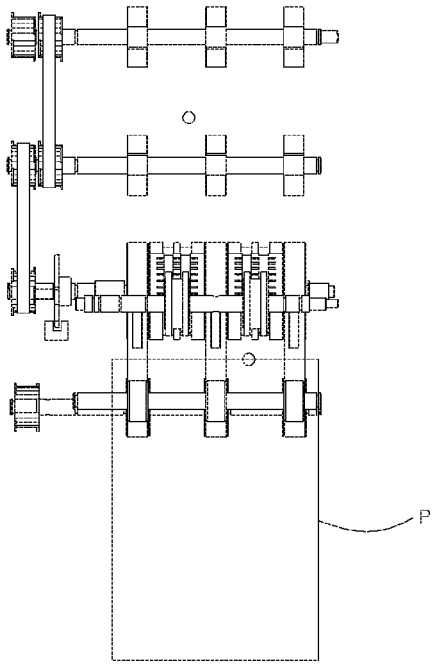
FIG. 9 is a schematic view of a fourth sheet separation state.
Figure 10:
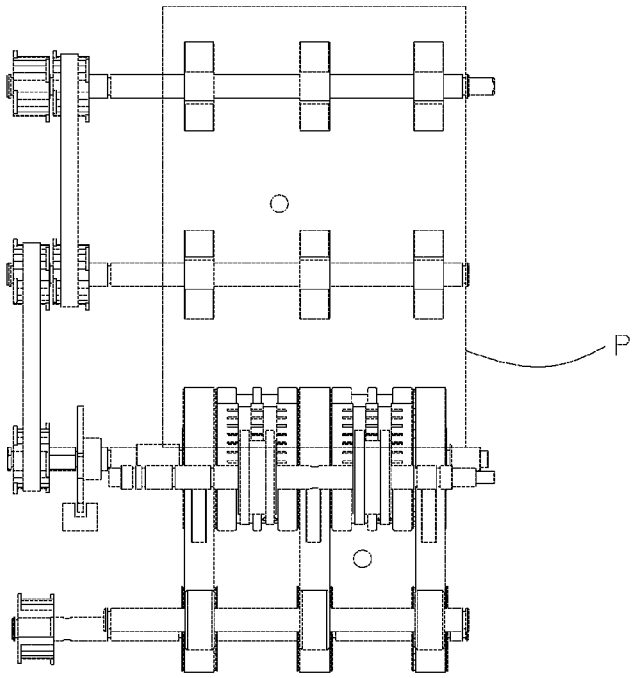
FIG. 10 is a schematic view of a fifth sheet separation state.

As shown in FIGS. 4 and 5, the basic structure of the banknote separating wheel assembly 111 includes a banknote separating wheel 111-1, a driven synchronous belt pulley 111-2 and a banknote separating rubber 111-3, wherein the coefficient of frictional of the banknote separating rubber 111-3 is larger than the coefficient of frictional of the banknote separating wheel 111-1, and the radius R1 of the banknote separating rubber 111-3 is approximately 0.1 mm larger than the radius R2 of the banknote separating wheel 111-1. The banknote separating wheel 111-1 is secured onto a rotating shaft, and the fitted driven synchronous belt pulley 111-2 can freely rotate relative to the banknote separating wheel 111-1. The banknote separating wheel encoder 119 is secured onto the rotating shaft, the opening direction and the opening angle of the banknote separating wheel encoder 119 may match with that of the banknote separating rubber 111-3, for example, if the angle of the banknote separating rubber 111-3 is 50 degree, the angle of the banknote separating wheel encoder 119 is 50+N degree, where N is set according to the response time of the control system and the banknote separation velocity; specifically, N is the angle that the banknote separating wheel rotates when the control system sends a command to motor for accelerating until the normal banknote separation velocity is reached.

Referring to FIGS. 6 to 10, the different states of the sheet matter separation mechanism in the process of sheet separation are shown. Generally, when it is necessary to separate a stack of sheet media, the stacked sheet media P are placed on the banknote picking wheel assembly 110 to be transferred and separated. When the existence of a sheet medium is detected by the sheet medium existence detecting sensor (a first sensor) 121, the system sends a command to control the banknote separating wheel motor 122 and the driving wheel motor of post-banknote separation 120 to rotate, and the banknote separating wheel velocity adjusting sensor (a second sensor) 114 detects a pass signal, the banknote separating wheel motor 122 and the driving wheel motor of post-banknote separation 120 rotate at the normal banknote separation velocity, and the banknote picking wheel assembly 110 and the banknote separating wheel assembly 111 may rotate synchronously; the banknote picking wheel assembly 110 can transfer the stacked sheet media P onto the banknote separating wheel assembly 111, a sheet medium may be separated from the stacked sheet media P under the functions of the banknote separating wheel assembly 111 and the reverse wheel assembly 112; the separated sheet medium P may be transferred forwardly under the clamping force applied by the rear pressure wheel 113 and the driving synchronous belt of post-banknote separation 118 (connected between the driving wheel assembly of post-banknote separation 116 and the banknote separating wheel assembly 111). When the banknote separating wheel velocity adjusting sensor 114 detects that the sheet medium P reaches, and the banknote separating wheel encoder sensor 117 detects that it is blocked by the banknote separating wheel encoder 119, the system immediately sends a command for controlling the banknote separating wheel motor 122 to be decelerated. The decelerated velocity has a maximum value, which is determined by the length of sheet medium and the normal banknote separation velocity, if the normal banknote separation velocity is V, the length of the longest sheet medium is L, the angle of the banknote separating rubber is $\alpha$, then the maximum value of the decelerated velocity of the banknote separating wheel motor 122 is $\omega=(360-\alpha)/(L/V)$. After velocity adjusting, the surfaces of the banknote picking wheel assembly 110 and the banknote separating wheel assembly 111 touching the stacked sheet media P have a small coefficient of friction, the stacked sheet media P can not be separated, therefore, there is no other sheet medium following with the separated sheet medium P1. The separated sheet medium P is continuously transferred forwardly under the clamping force applied by the second rear pressure wheel 115 and the driving synchronous belt of post-banknote separation 118, and if the banknote separating wheel velocity adjusting sensor 114 detects that the sheet medium P leaves, the system sends a command for controlling to accelerate immediately banknote separating wheel motor 122; another sheet medium P may be separated at this point, thus the gap between the sheet medium P2 and the sheet medium P1 can be ensured as the L; repeating the steps, the whole stacked sheet media can be separated. If the sheet medium existence detecting sensor 121 detects no sheet medium, the system sends a command for controlling the banknote separating wheel motor 122 to stop and the driving wheel motor of post-banknote separation 120 to stop with a delay, then the whole banknote separating process is completed.

Figure 11:
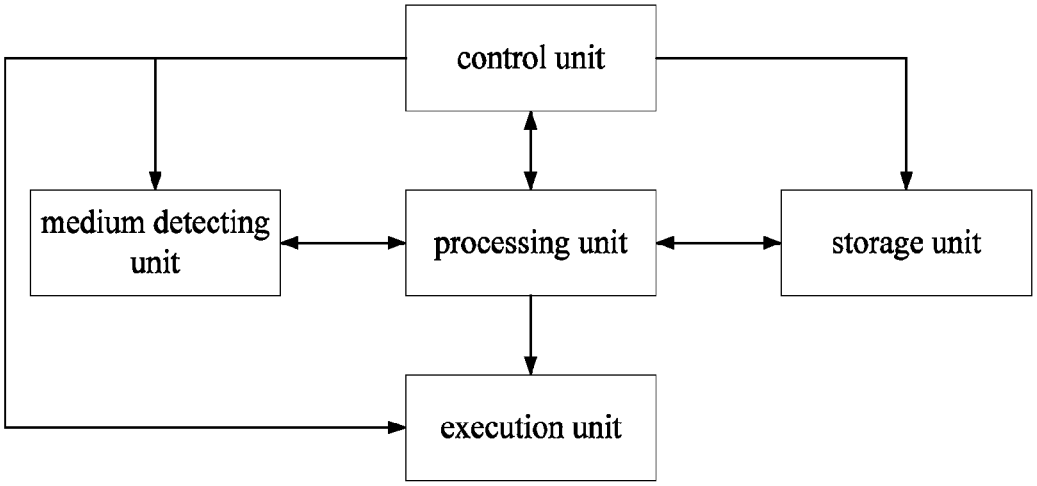
FIG. 11 is a principle block diagram of a system for controlling the sheet matter separation mechanism shown in FIG. 1.
Figure 12:
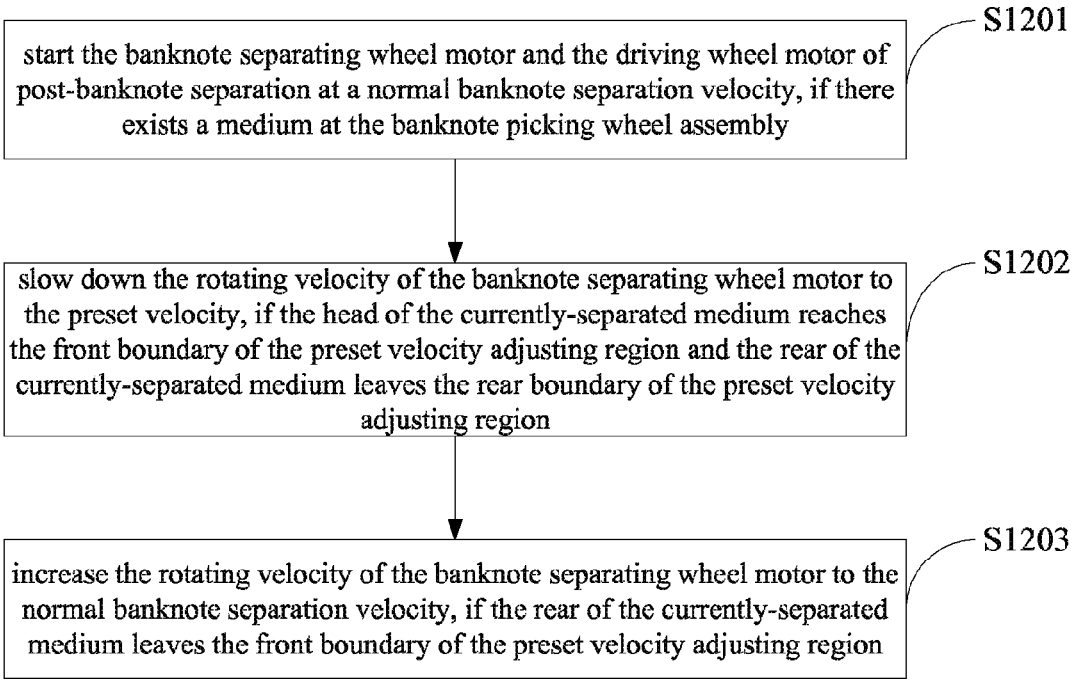
FIG. 12 is a flow chart of a method for controlling the sheet matter separation mechanism shown in FIG. 1.
Figure 13:
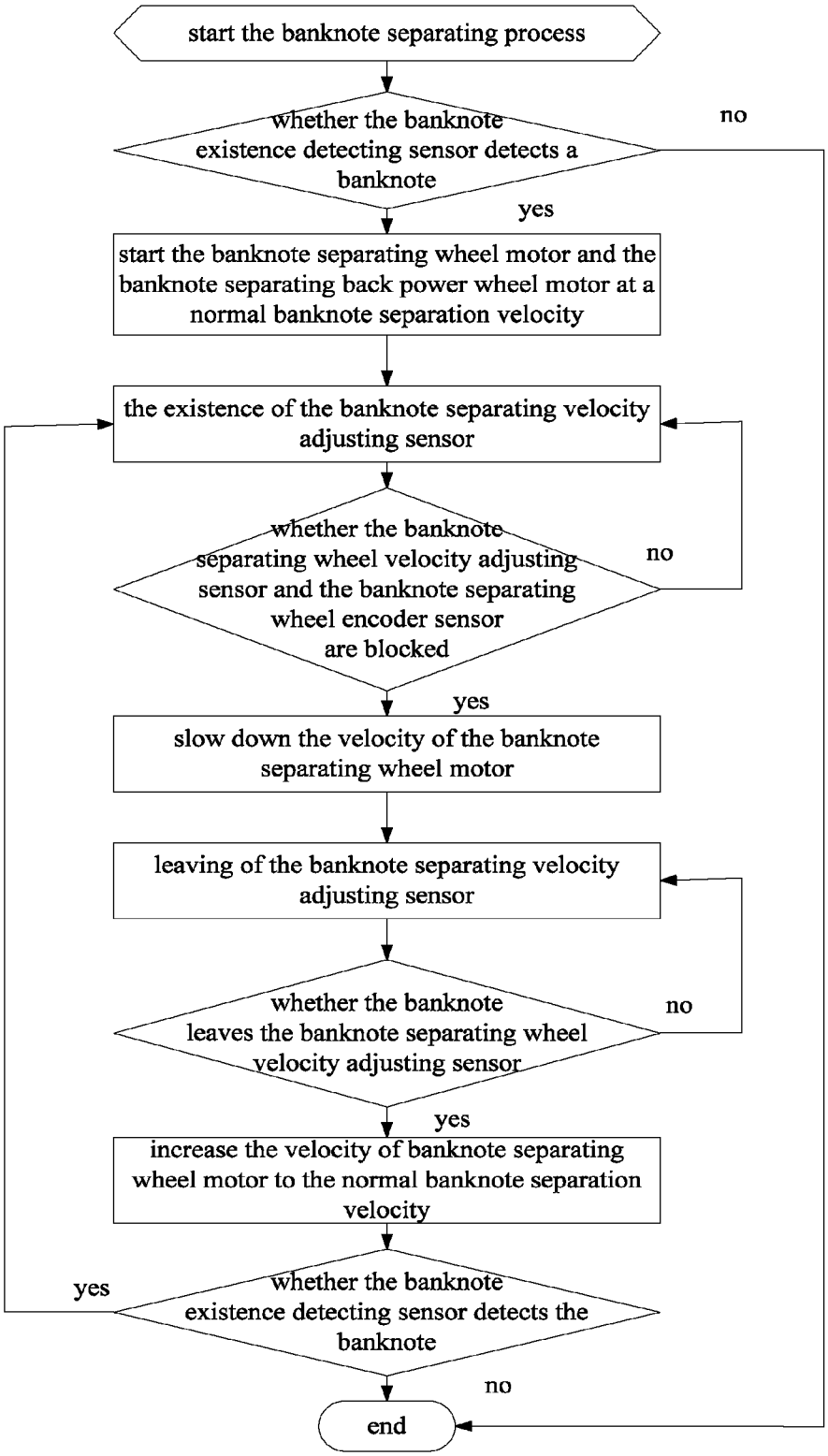
FIG. 13 shows the specific work process based on the method for controlling the sheet matter separation mechanism shown in FIG. 12.

Referring to FIGS. 11 to 13, the system and the method for controlling the sheet matter separation mechanism of the invention are further described.

As shown in FIG. 11, the system includes a medium detecting unit, a processing unit, an execution unit, a storage unit, and a control unit that are electrically connected to each other, wherein:

the medium detecting unit includes a first sensor mounted at the banknote picking wheel assembly, a second sensor mounted at the front boundary of the preset velocity adjusting region, and a third sensor mounted at the rear boundary of the preset velocity adjusting region. Specifically, the first sensor and the second sensor may be photoelectric sensors, which output an on/off signal according to whether the first sensor and the second sensor are blocked by the medium on the detection position. Preferably, the third sensor is a banknote separating wheel encoder sensor, the banknote separating wheel encoder is fitted on the rotating shaft of the banknote separating wheel, and the opening direction and the opening angle of the banknote separating wheel encoder match with that of the banknote separating rubber; therefore, the banknote separating wheel encoder sensor can output an on/off signal according to the opening position of the banknote separating wheel encoder. Because the opening position of the banknote separating wheel encoder corresponds to the position of the banknote separating rubber, the detection of the position of the banknote separating rubber is also achieved indirectly by detecting the opening position of the banknote separating wheel encoder, thus, determining whether the rear of the medium leaves the rear boundary of the preset velocity adjusting region, i.e. the end position of the banknote separating rubber on the banknote separating wheel is achieved.

The processing unit is adapted to output a first control signal if the detection signal of the first sensor indicates that there exists a medium at the banknote picking wheel assembly, to output a second control signal when the detection signal of the second sensor indicates that the front of the currently-separated medium reaches the front boundary of the preset velocity adjusting region and the detection signal of the third sensor indicates that the rear of the currently-separated medium leaves away from the rear boundary of the preset velocity adjusting region, and to output a third control signal when the detection signal of the second sensor indicates that the rear of the currently-separated medium leaves the front boundary of the preset velocity adjusting region.

The execution unit includes a banknote separating wheel motor and a driving wheel motor of post-banknote separation, wherein the banknote separating wheel motor and the driving wheel motor of post-banknote separation are started at the normal banknote separation velocity according to the first control signal; the banknote separating wheel motor decelerates to the preset velocity according to the second control signal; the banknote separating wheel motor accelerates to the normal banknote separation velocity according to the third control signal.

Storage unit is adapted to read and write the control parameters required by the processing unit.

Control unit is adapted to dispatch and control the processes of the medium detecting unit, the processing unit, the execution unit, a detection module and the storage unit.

As shown in FIG. 12, the steps of a method for controlling the sheet matter separation mechanism are as follows:

determining whether there exists a medium at the banknote picking wheel assembly, if yes, starting the banknote separating wheel motor and the driving wheel motor banknote separating back power wheel motor at a normal banknote separation velocity (step S1201);

determining whether the front of the currently-separated medium reaches the front boundary of the preset velocity adjusting region and the rear of the currently-separated medium leaves the rear boundary of the preset velocity adjusting region, if yes, slowing down the rotating velocity of the banknote separating wheel motor to the preset velocity which is a velocity adjusting threshold value determined according to the length of the medium and the normal banknote separation velocity (S1202);

determining whether the rear of the currently-separated medium leaves the front boundary of the preset velocity adjusting region, if yes, increasing the rotating velocity of the banknote separating wheel motor to the normal banknote separation velocity (step S1203).

As shown in FIG. 13, the specific work processes based on the control method mentioned above are as follows: during the banknote separation, if the first sensor (sheet medium existence detecting sensor) in the medium detecting unit detects the existence of the sheet medium, the first sensor feeds back a signal to the processing unit, the processing unit sends a command signal to the execution unit for controlling the banknote separating wheel motor and the driving wheel motor of post-banknote separation in the execution unit, so that the separated medium is transferred forwardly; if the second sensor (the banknote separating wheel velocity adjusting sensor) in the medium detecting unit detects that the separated medium reaches, and if the third sensor (banknote separating wheel encoder sensor) detects that it is blocked, then a signal is fed back to the processing unit, the processing unit performs a process according to the data in the storage unit, and then sends a command for controlling the banknote separating wheel motor to be decelerated; if the second sensor detects that the separated medium leaves, and the third sensor detects that it is not blocked, then a signal is fed back to the processing unit, the processing unit performs a process according the data in the storage unit, and then sends a command for controlling the banknote separating wheel motor to be accelerated, so as to continue to separate the medium; the distance between the front of the separated medium and the rear of the previously-separated medium is the distance from the front of the separated medium to the second sensor, this distance is fixed, so that the fixed spacing between the media can be ensured. Repeating the steps, until the first sensor detects no sheet medium, then the first sensor feeds back a signal to the processing unit, the processing unit sends a command to stop the banknote separating wheel motor in the execution unit and stop the driving wheel motor of post-banknote separation with delay. Up to this point, the entire banknote separating process is completed.

The above are only preferred embodiments of the invention. It should be noted that the above preferred embodiments should not be regarded as limiting the invention, and the scope of protection of the invention should be defined by the claims. Also, numerous variations and modifications can be made by those skilled in the art without departing from the spirit and scope of the invention, and these variations and modifications should also be deemed as falling into the scope of protection of the invention.

The invention claimed is:

1. A sheet matter separation mechanism, comprising:

a banknote picking wheel assembly and a banknote separating wheel assembly driven by a banknote separating wheel motor synchronously;

a driving wheel assembly of post-banknote separation driven by a driving wheel motor of post-banknote separation; and a banknote separating rubber being fitted on a banknote separating wheel of the banknote separating wheel assembly, the banknote separating rubber touching a medium for one time with the help of rotation of the banknote separating wheel for one circuit;

wherein if a front of a currently-separated medium reaches a front boundary of a preset velocity adjusting region in front of the banknote separating wheel and a rear of the currently-separated medium leaves a rear boundary of the preset velocity adjusting region, a relative velocity between the banknote separating wheel motor and the driving wheel motor of post-banknote separation is adjusted, such that a preset medium separation spacing is kept between a rear of the currently-separated medium and a front of a next-separated medium; and wherein a driving synchronous belt of post-banknote separation is connected between the driving wheel assembly of post-banknote separation and the banknote separating wheel assembly.

2. The sheet matter separation mechanism according to claim 1, wherein the front boundary of the preset velocity adjusting region corresponds to a position that is at a distance of a maximum permitted medium length in front of a minimum spacing between the banknote separating wheel and a reverse wheel, and the rear boundary of the preset velocity adjusting region corresponds to a position where the medium leaves the banknote separating rubber on the banknote separating wheel.

3. The sheet matter separation mechanism according to claim 1 wherein a first rear pressure wheel and a second rear pressure wheel are provided above the driving synchronous belt of post-banknote separation the first rear pressure wheel is close to a banknote separating spacing formed by the banknote separating wheel and the reverse wheel, and the second rear pressure wheel is close to the driving wheel assembly of post-banknote separation.

4. A method for controlling a sheet matter separation mechanism, wherein the sheet matter separating mechanism comprises:

a banknote picking wheel assembly and a banknote separating wheel assembly driven by a banknote separating wheel motor synchronously;

a driving wheel assembly of post-banknote separation driven by a driving wheel motor of post-banknote separation; and a banknote separating rubber being fitted on a banknote separating wheel of the banknote separating wheel assembly, the banknote separating rubber touching a medium for one time with the help of rotation of the banknote separating wheel for one circuit;

wherein if a front of a currently-separated medium reaches a front boundary of a preset velocity adjusting region in front of the banknote separating wheel and a rear of the currently-separated medium leaves a rear boundary of the preset velocity adjusting region, a relative velocity between the banknote separating wheel motor and the driving wheel motor of post-banknote separation is adjusted, such that a preset medium separation spacing is kept between a rear of the currently-separated medium and a front of a next-separated medium;

wherein the method for controlling the sheet matter separating mechanism comprises:

determining whether there exists a medium at the banknote picking wheel assembly, if yes, starting the banknote separating wheel motor and the driving wheel motor of post-banknote separation at a normal banknote separation velocity;

determining whether the front of the currently-separated medium reaches the front boundary of the preset velocity adjusting region and the rear of the currently-separated medium leaves the rear boundary of the preset velocity adjusting region, if yes, slowing down the rotating velocity of the banknote separating wheel motor to a preset value; and determining whether the rear of the currently-separated medium leaves the front boundary of the preset velocity adjusting region, if yes, increasing the rotating velocity of the banknote separating wheel motor to a normal banknote separation velocity.

5. A system for controlling the sheet matter separation mechanism, wherein the sheet matter separating mechanism comprises:

a banknote picking wheel assembly and a banknote separating wheel assembly driven by a banknote separating wheel motor synchronously;

a driving wheel assembly of post-banknote separation driven by a driving wheel motor of post-banknote separation; and a banknote separating rubber being fitted on a banknote separating wheel of the banknote separating wheel assembly, the banknote separating rubber touching a medium for one time with the help of rotation of the banknote separating wheel for one circuit;

wherein if a front of a currently-separated medium reaches a front boundary of a preset velocity adjusting region in front of the banknote separating wheel and a rear of the currently-separated medium leaves a rear boundary of the preset velocity adjusting region, a relative velocity between the banknote separating wheel motor and the driving wheel motor of post-banknote separation is adjusted, such that a preset medium separation spacing is kept between a rear of the currently-separated medium and a front of a next-separated medium;

wherein the system for controlling the sheet matter separation mechanism comprises:

a medium detecting unit comprising a first sensor mounted at the banknote picking wheel assembly, a second sensor mounted at the front boundary of the preset velocity adjusting region, and a third sensor mounted at the rear boundary of the preset velocity adjusting region;

a processing unit, adapted to output a first control signal if a detection signal of the first sensor indicates that there exists a medium at the banknote picking wheel assembly, output a second control signal if a detection signal of the second sensor indicates that the front of the currently-separated medium reaches the front boundary of the preset velocity adjusting region and a detection signal of the third sensor indicates that the rear of the currently-separated medium leaves the rear boundary of the preset velocity adjusting region, and output a third control signal if the detection signal of the second sensor indicates that the rear of the currently-separated medium leaves the front boundary of the preset velocity adjusting region; and an execution unit comprising the banknote separating wheel motor and the driving wheel motor of post-banknote separation, the banknote separating wheel motor and the driving wheel motor of post-banknote separation are started at a normal banknote separation velocity according to the first control signal; the banknote separating wheel motor is decelerated to a preset velocity according to the second control signal; the banknote separating wheel motor is accelerated to the normal banknote separation velocity according to the third control signal.

6. The system according to claim 5, further comprising a storage unit, adapted to read and write control parameters required by the processing unit.

7. The system according to claim 6, further comprising a control unit, adapted to dispatch and control processes of the medium detecting unit, the processing unit, the execution unit, a detection module and the storage unit.

8. The system according to claim 5, wherein the third sensor is a banknote separating wheel encoder sensor, a banknote separating wheel encoder is fitted on a rotating shaft of the banknote separating wheel, an opening direction and an opening angle of the banknote separating wheel encoder respectively match with that of the banknote separating rubber.

9. The sheet mater separation mechanism according to claim 2, wherein a driving synchronous belt of post-banknote separation is connected between the driving wheel assembly of post-banknote separation and the banknote separating wheel assembly.

10. The system according to claim 6, wherein the third sensor is a banknote separating wheel encoder sensor, a banknote separating wheel encoder is fitted on a rotating shaft of the banknote separating wheel, an opening direction and an opening angle of the banknote separating wheel encoder respectively match with that of the banknote separating rubber.

11. The system according to claim 7, wherein the third sensor is a banknote separating wheel encoder sensor, a banknote separating wheel encoder is fitted on a rotating shaft of the banknote separating wheel, an opening direction and an opening angle of the banknote separating wheel encoder respectively match with that of the banknote separating rubber.

* * * * *